US008481108B2

(12) United States Patent
Roth et al.

(10) Patent No.: US 8,481,108 B2
(45) Date of Patent: Jul. 9, 2013

(54) UV AND THERMAL GUARD AND A PROCESS OF MAKING AND USING THEREOF

(75) Inventors: Joseph D Roth, Springboro, OH (US); Wendell B Halbrook, Jr., Waynesville, OH (US); Charles Q Maney, Dayton, OH (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/313,189

(22) Filed: Dec. 7, 2011

(65) Prior Publication Data

US 2012/0073744 A1 Mar. 29, 2012

Related U.S. Application Data

(62) Division of application No. 11/581,318, filed on Oct. 16, 2006, now Pat. No. 8,222,184.

(60) Provisional application No. 60/779,781, filed on Mar. 7, 2006, provisional application No. 60/779,782, filed on Mar. 7, 2006.

(51) Int. Cl.
*B41M 5/323* (2006.01)

(52) U.S. Cl.
USPC ..... 427/145

(58) Field of Classification Search
USPC ..... 425/145; 427/145
See application file for complete search history.

(56) References Cited

U.S. PATENT DOCUMENTS

| | | | | |
|---|---|---|---|---|
| 6,054,256 | A * | 4/2000 | Nohr et al. | 430/339 |
| 6,432,875 | B1 * | 8/2002 | Akutsu et al. | 503/209 |
| 6,472,214 | B2 * | 10/2002 | Patel | 436/2 |
| 6,544,925 | B1 * | 4/2003 | Prusik et al. | 503/201 |
| 2002/0167989 | A1 * | 11/2002 | Russo | 374/141 |
| 2004/0253733 | A1 * | 12/2004 | Prusik et al. | 436/2 |

* cited by examiner

*Primary Examiner* — Elena T Lightfoot
(74) *Attorney, Agent, or Firm* — Charles Q. Maney; Michael Chan

(57) ABSTRACT

A process of making an image element having an imperceptible message that becomes readily apparent when the image element is exposed to an excessive amount of heat and/or UV radiation is provided. The process comprises providing a first thermally sensitive coating on at least a first portion of the image element; pre-printing a first mark on the first portion of the image element, wherein the first pre-printed mark comprises non-thermally sensitive ink. The image element may be associated with a material such that, upon becoming readily apparent, the imperceptible message provides a warning that the material has been exposed to excessive heat and/or UV radiation.

16 Claims, 5 Drawing Sheets

UV AND THERMAL GUARD AND A PROCESS OF MAKING AND USING THEREOF

RELATED APPLICATIONS

This application is a Divisional Application of, and claims priority to, U.S. application Ser. No. 11/581,318, filed Oct. 16, 2006, entitled "UV AND THERMAL GUARD", now U.S. Pat. No. 8,222,184, which claims the benefit of U.S. Provisional Application Nos. 60/779,781 and 60/779,782, filed on Mar. 7, 2006, all of which are hereby incorporated by reference herein in their entirety for all purposes.

TECHNICAL FIELD

Various embodiments relate to thermal printing, and in an embodiment, but not by way of limitation, thermal printing for pharmaceutical packages.

BACKGROUND

Two-sided, or dual-sided, direct thermal printing of documents such as transaction documents and receipts is described in U.S. Pat. Nos. 6,784,906 and 6,759,366, which are hereby incorporated by reference herein. In dual-sided direct thermal printing, the printers are configured to allow concurrent printing on both sides of thermal media or image elements moving along a feed path through the printer. In such printers a direct thermal print head is disposed on each side of the media along the feed path. In operation each thermal print head faces an opposing platen across the media from the respective print head.

In direct thermal printing, a thermal print head selectively applies heat to paper or other sheet media comprising a substrate with a thermally sensitive coating. The coating changes color or is imaged when heat is applied, by which "printing" is provided on the coated substrate. For dual-sided direct thermal printing, the sheet media substrate may be coated on, and heated from, both sides.

Many industries produce products that to some degree are sensitive to heat and/or UV exposure and/or that degrade to an unacceptable extent when exposed to excessive heat and/or UV radiation. One such example is the beverage industry, including alcoholic, non-alcoholic, refrigerated, and non-refrigerated beverages. Another example is the pharmaceutical industry wherein many medications lose their potency or their effectiveness when exposed to adverse environmental conditions such as excessive heat or UV radiation. Such industries would benefit from a system to identify products that have been exposed to excessive heat and/or UV radiation.

SUMMARY

In one embodiment, an article of manufacture comprising an image element is provided. The image element has a first side and a second side, each side having a thermally sensitive coating deposited thereon. Further, the first side includes a first printed mark covering a portion of the first side of the image element, wherein the first printed mark becomes visible at a predetermined temperature.

In another embodiment, an article of manufacture comprising an image element is provided. The image element has a first side and a second side, each side having a thermally sensitive coating deposited thereon. Further, the first side includes a first printed mark covering a portion of the first side of the image element, wherein the first printed mark becomes visible at a predetermined UV radiation exposure.

BRIEF DESCRIPTION OF THE DRAWINGS

FIG. 1 illustrates an example embodiment of a dual-sided direct thermal printer for dual-sided printing of media such as transaction receipts, tickets, labels and the like.

DETAILED DESCRIPTION

By way of example, various embodiments of the invention are described in the material to follow with reference to the included drawings. Variations may be adopted.

Background material applicable to direct thermal printing and related media production and their common features are generally described in U.S. Pat. No. 6,803,344, the disclosure of which is hereby incorporated by reference herein.

Figure 1:
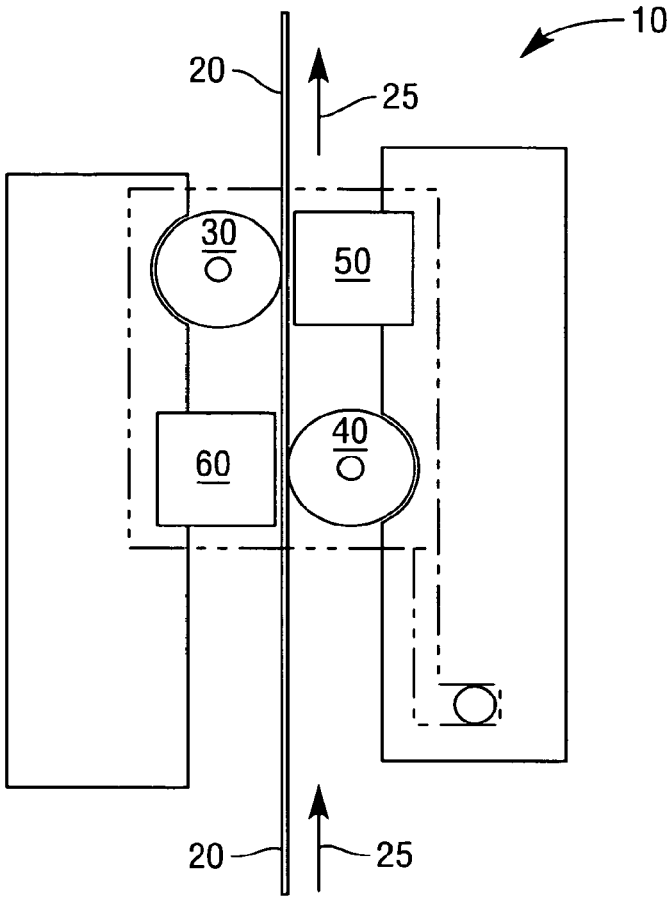

FIG. 1 shows a schematic of a dual-sided direct thermal printer 10 for dual-sided printing of an image element such as print media 20. The printer 10 operates on print media 20 which is double-sided thermal paper, e.g., comprising a cellulose or polymer based substrate sheet coated on each side with thermally sensitive dyes as described in U.S. Pat. Nos.

6,784,906 and 6,759,366. Print media 20 may further comprise one or more of a base coat or coats below the thermally sensitive layer and a top coat or coats above the thermally sensitive layers on one or both sides to the print media 20. Further, the print media 20 may comprise one or more receipts, tickets, labels and the like, provided in roll, fanfold or sheet form.

As shown in FIG. 1, the dual-sided direct thermal printer 10 has rotating platens 30 and 40 and opposing thermal print heads 50 and 60 on opposite sides of the media 20. As such, dual-sided direct thermal printing of the media 20 can occur in a single pass of the media 20 through the printer 10. Additionally, some or all of the dual-sided direct thermal printing may occur during or subsequent to a retraction of previously imaged portions of the media 20 into the printer 10, and the like. The media 20 may also be cut or severed to provide an individual receipt, ticket document, label, pharmaceutical script, or such like, either manually or automatically using, e.g., a static or electromechanically actuated knife (not shown), typically once printing is completed.

The substrate or base sheet of the media 20 may comprise materials used in conventional, single-sided direct thermal printing applications. These include non-woven materials derived from natural fibers such as cellulose (pulp), or synthetic fibers such as polyethylene or polyester. The substrate or base sheet of the media 20 may also comprise extruded films of materials such as polyimide, polyethylene, polypropylene, polyester and the like.

The substrate or base sheet materials may further be provided with a combination of a sub-coat, a thermally sensitive or functional coat, and/or a topcoat. These layers may be applied to one or both sides of the substrate film or web as necessary to construct the final, two-sided thermal media product.

Generally a two-sided thermal media 20 can be expected to have a thickness in the range of 1.8 to 70 mils, a weight in the range of 11 to 115 lbs/1300 SFR (square foot ream), and opacity in excess of 80%, depending upon the application or end-use requirements, although other specifications are possible.

Calendering may be provided to produce a smoothness of 75 Bekk or greater on one or both sides of the media 20 to improve the thermal imaging. A subcoat or base coat comprising predominantly calcium carbonate or clay and a binder such as a latex-based material, may be provided on paper substrates to enhance smoothness of finish and the quality of direct thermal printing. Without a subcoat, a typical smoothness achieved by calendering of base paper before applying thermally sensitive coatings would be in the range of 75-150 Bekk. With a subcoat and calendering a finished smoothness of 250 Bekk or greater is typical. To give higher quality thermal imaging characteristics, e.g., for bar code or other high quality image printing, a minimum finished smoothness of 300 Bekk should be used. Where used, a subcoat weight of about 1-10 lbs/3300 SFR per side for one or both sides, preferably 2-5 lbs/3300 SFR per side for one or both sides, is generally typical.

A subcoat where used could be the same on each side or have a different composition or weight on each side of the media 20, again depending upon cost and application considerations. For example, if there is to be any ink jet printing as well as direct thermal printing on a particular side a calcium carbonate subcoat may be preferred.

Calendering to provide smoothness of one or both sides of the media 20 can comprise, e.g., on-line or off-line soft or soft nip calendering or supercalendering in one or more pass operations. Supercalendering, typically performed off-line from a paper production line, may be performed using a stack of alternating chilled cast iron and fiber-covered rolls. The fiber-covered rolls may for example be covered with highly compressed paper for processing uncoated papers, or with highly compressed cotton for processing papers with coatings. In a soft calender, a composite-covered crown roll can run against a heated metal roll, e.g., in an in-line process, to produce a desired sheet surface finish and gloss. To calender both sides of the media 20 in one pass, two or more roll stacks may be used.

Calendering of one or both sides of the media 20 for two-sided direct thermal printing has the benefit of providing the desired degree of smoothness to achieve a print quality required for a given application. The smoother the media 20 the less the print head wear and concomitant abrasion of the media 20 will be. A calendered subcoated surface of the media 20 also minimizes potentially adverse substrate interaction with thermally sensitive coating components.

The thermally sensitive coatings are preferably of the dye-developing type particularly when used with opaque paper substrates for the media 20, e.g., for two-sided direct thermal printing applications. Such coatings would typically comprise a developer, an optional sensitizer and color former or dye, e.g., a leuco-dye, and undergo a color change upon transfer of heat. Different thermally sensitive coatings, e.g., of the dye-developing type or the dye-sublimation type, can be used with differing substrates, e.g., plastic or cellulosic substrate materials. The dye-developing type thermally sensitive coating, e.g., overlying the subcoat where used, would generally have a weight of about 1-8 lbs/3300 SFR, or preferably about 1-3 lbs/3300 SFR. Without a subcoat, the weight of a thermally sensitive layer will typically be greater.

A subcoat can be used on one side or both sides and the degree of calendering or finished smoothness can be the same or different on each side of the media 20, according to considerations of cost and the requirements of particular applications involved. For example, a higher quality of printing may be required for one side such as where printing of a bar code may be required. Such an application would normally require use of a subcoat and calendering to a finished smoothness 300 Bekk or greater on the bar code print side of the media 20. The same finish or a less expensive finish might be used for the other side of the media 20. Similarly the character, chemical composition, thermal sensitivity and cost of the thermally sensitive coating could be the same or different on each of the two sides, e.g., a sensitizer may be used on one or both sides of the media 20 depending upon application. Different chemistries on the two sides of the media 20, such as different dyes, developers, and/or sensitizers, may be employed to provide different environmental compatibilities, properties, or other desired product characteristics.

In dye-developer systems, dyes and developers are typically mixed with sensitizers to form a blend with a reduced melting point through, for example, forming a eutectic compound with one or both of the dye and the developer. This lowers the melting point of these compounds and results in the color forming reaction taking place at a lower temperature and/or amount of energy input. In this way the chemistry of the thermally sensitive or functional coating may be varied to obtain desired environmental conditions, such as temperature, for imaging one or both sides of a two-sided thermal media 20.

In one example, the chemistry and resultant imaging temperature of one or both sides of a two-sided thermal media 20 may be varied to match the operating temperature of a particular thermal printer. The operating temperature of conventional thermal printers varies widely, but is typically within the range of 50 to 250 degrees C. In another example, the chemistry of one or both sides of a two-sided thermal media 20 may be varied to set environmental conditions, such as an ambient or storage temperature, at or above which the one or both sides of the thermal media 20, or portion thereof, will become imaged. One skilled in the art can readily select a thermally sensitive or functional coating chemistry, e.g., dye, developer and/or sensitizer, with appropriate properties such as dye-developer melting point and, therefore, media imaging temperature, to meet the needs of a particular application.

In addition to imaging of the media, the environmental conditions to which thermal media is exposed can affect the longevity of direct thermal printing of text, graphics and the like. For example, thermal media print longevity can be adversely affected by the amount of UV radiation the media is exposed to. UV radiation adversely impacts printed or imaged media longevity through, for example, photochemical reaction of the thermal media 20, resulting in progressive fading of the thermal print image.

The longevity of direct thermal printing, including degradation due to the influence of UV radiation, can be influenced through control of the chemistry comprising the thermal coating, including selection of the dye, developer and/or sensitizer. However, thermal print degradation due to the influence of UV radiation can also be controlled through the use of one or more UV absorbing materials comprising one or more UV absorbing compounds on or in the thermal media. Effective, inorganic UV absorbing compounds include titanium dioxide, zinc oxide and combinations of the two, as described in U.S. Pat. No. 6,613,403, the disclosure of which is hereby incorporated by reference herein. Additionally, effective, organic UV absorbing compounds include phenolic compounds such as hydroxy-substituted benzophenones, aryl salicylates, benzotriazoles and triazines, and non-phenolic compounds such as oxanilides, 2-cyanoacrylates, benzylidene malonates and formamidines, and the like. Such materials may be applied as a separate coating above the thermal or functional coating or coatings on one or both sides of a thermal media. However they may also be incorporated with the thermal coating or coatings, or be applied both with and above the thermal coating or coatings. Additionally, such materials may be applied as a spot, strip or pattern coating covering a portion of one or both sides of a thermal media, or be incorporated in a material such as an ink selectively applied to one or both sided of the thermal media, and the like. Preferably, a topcoat comprising zinc oxide is used above the thermal or functional coating or coatings on one or both sides, or portions of a two-sided thermal media 20.

The thermally sensitive coatings on each side of a two-sided thermal media 20 can provide for single color printing on each side of the media 20, where the print color is the same or different on each side of the media 20. Alternatively, multiple color direct thermal printing may be implemented on one or both sides of a thermal media 20 using multiple thermally sensitive coatings or layers, e.g., as taught in U.S. Pat. No. 6,906,735. Such multi-color direct thermal media may comprise multiple dyes within a coating layer, or multiple coating layers comprising one or more dyes each. Such dyes or layers may be individually sensitive to different temperatures or heat inputs to effectuate control over the multi-color printing. Likewise, the available print color choices may be the same or different on each side of a two-sided thermal media 20.

In some applications it may be desirable to provide a single or multi-color thermally sensitive coating on one or both sides of the media 20 in the form of a spot, strip or pattern coating, or to provide for a spot, strip or pattern of special or higher cost finish or print on one or both sides. For example, to provide for printing of a bar code at a particular location on the media 20 the requisite smoothness of finish and thermally sensitive coating could be limited to that location. Repetitive sense marks could be applied to one or both sides of the media 20 to allow the bar code printing location to be identified during the bar code printing process. For some applications the sense marks could have different repeat lengths on opposite sides of the media 20, e.g., to allow for different intended print areas.

For image protection and environmental durability, a topcoat can be applied over the thermally sensitive coating on one or both sides of the media 20. Where used, the topcoat could comprise a spot, strip or pattern coating, and the like, e.g., for the added protection of a bar code. Repetitive sense marks could be applied to the media 20 to help identify the particular topcoat spot, strip or pattern locations.

The media 20 may also be provided with one or more areas pre-printed by thermal or non-thermal printing, such as inks, on at least one side of the media 20, e.g., for security features, pre-printing of standard terms, advertising, and the like, depending on application requirements. The pre-printing could also be used to provide a colored background area affecting the color of a final image. For example, yellow ink over a red dye-developer thermal paper could be used to provide an orange final image color. Repetitive sense marks could be applied to help identify the one or more pre-printed areas in subsequent thermal or non-thermal printing of the media 20.

Pre-printing can also be used to provide initially hidden or covert messages which become visible when the media 20 is imaged. Likewise, pre-printing can be used to provide an initially visible message which becomes indiscernible or invisible when the media 20 is imaged. Such messages may comprise warnings related to safe handling, use, storage and the like of a product, such as a medication, with which the media 20 is associated.

In one embodiment, initially hidden or covert messages may be provided on the media 20 through use of an ink whose color is the same as the un-printed media, e.g., white ink on white media 20. Likewise, in another embodiment, initially visible messages may be provided on the media 20 through use of an ink whose color is different than that of the un-imaged media, but similarly colored to the imaged media such that the message becomes invisible or hidden upon imaging of the media 20. Other colors and/or color combinations, or pre-printing means, such as using a second thermally sensitive coating different than a first or primary thermally sensitive coating for pre-printing of the media 20, or pre-printing with a UV absorbing material, are also possible.

Pre-printed thermal media may be used to provide, for example, indicia for safe guarding of heat and/or UV sensitive materials, e.g., medication in pill bottles, from excessive thermal or UV exposure. Such media may be associated with the heat and/or UV sensitive material, e.g., as a document provided with the material, be an integral part of a label attached to a container encasing and/or enclosing the heat and/or UV sensitive material, and the like.

Figure 2A:
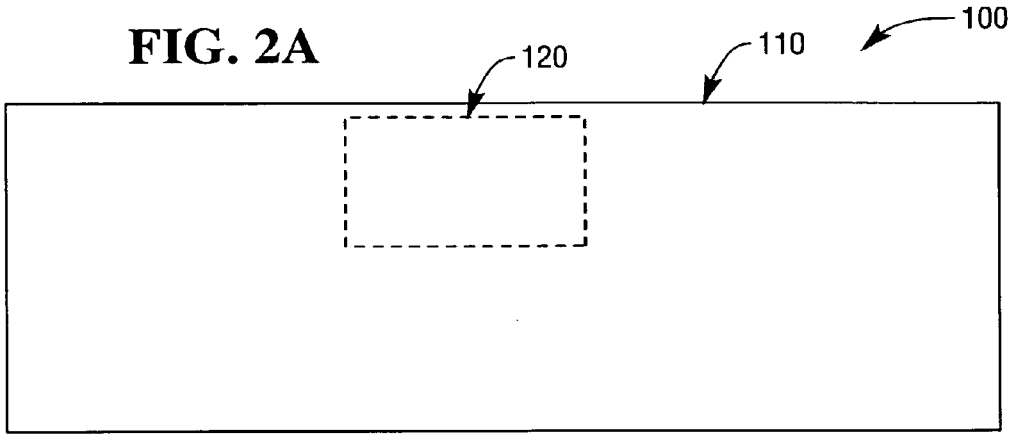
FIG. 2A illustrates an example embodiment of a pharmaceutical label with an invisible pre-printed message.

As shown in FIG. 2A, one embodiment of such a pre-printed thermal media is image element 100, e.g., a cellulosic substrate with a subcoat, a thermally sensitive functional coat, a pre-printed message, and/or a topcoat. Image element 100 is provided in the form of a pharmaceutical label 110. The thermally sensitive coating of pharmaceutical label 110 has been selected to image at a temperature at or above which the medication with which the label is associated will lose its potency, effectiveness or the like. Pharmaceutical label 110 has a white (undeveloped and/or unimaged) background with a warning message 120 pre-printed on the pharmaceutical label 110 using an opaque white ink. As shown in FIG. 2A, the white on white printing is initially invisible, or not obviously visible, to an observer.

Figure 2B:
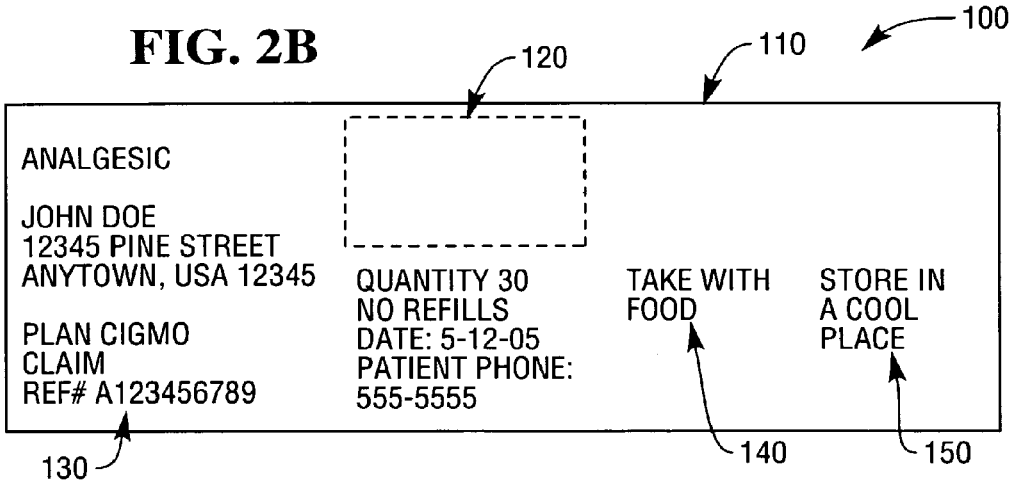
FIG. 2B illustrates an example embodiment of the pharmaceutical label of FIG. 2A selectively imaged to include prescription information, and the like, in regions surrounding the invisible pre-printed message.

In FIG. 2B, the pharmaceutical label 110 of FIG. 2A is shown with selective thermal printing or imaging comprising patient and prescription information 130, administering information 140, storage and handling information 150, and the like. Additional information and/or images are, however, also possible. Selective thermal printing of the pharmaceutical label 110 occurs using, for example, the two-sided direct thermal printer 10 of FIG. 1 to image regions of the pharmaceutical label 110 surrounding, but not including, the region where the warning message 120 is pre-printed.

Figure 2C:
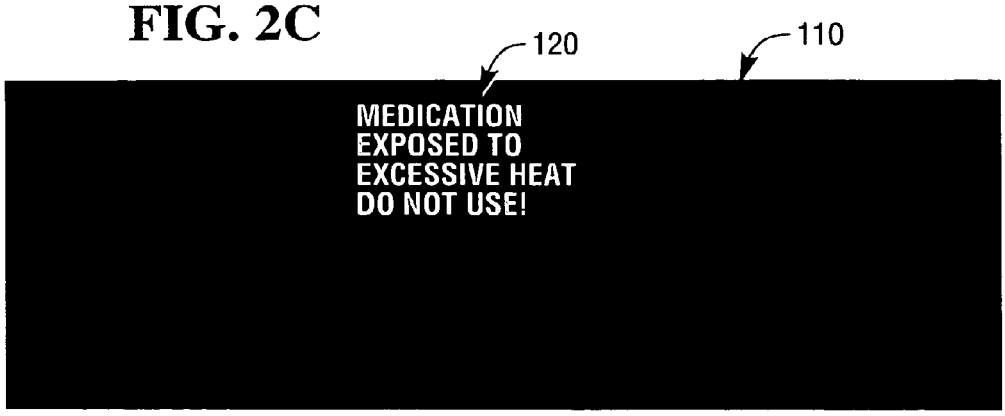
FIG. 2C illustrates an example embodiment of the pharmaceutical label of FIGS. 2A and 2B after exposure to excessive temperature.

Subsequently, as shown in FIG. 2C, when the pharmaceutical label 110 is exposed to excessive temperature, e.g., above the selected imaging temperature of the thermally sensitive (functional) coating, the entire label 110 images, which in this embodiment comprises the label 110 turning black. Upon this imaging, the previously indiscernible or invisible white printing associated with the warning message 120 becomes visible, warning a user to not take or use the medication with which the pharmaceutical label 110 is associated. Likewise, the thermally printed prescription information 130, administering information 140, and storage and handling information 150 become invisible or indiscernible against the imaged background. Various stages of imaging where some or all of the pre-printed warning message 120 become visible and some or all of the prescription information 130, administering information 140, storage and handling information 150, and like information become invisible or difficult to discern are, however, also possible.

As previously described, conditions resulting in the imaging of the thermally sensitive or functional coating of the pharmaceutical label 110 are determined through the chemistry, e.g., dye, developer and sensitizer, of the coating. In the embodiment of FIGS. 2A, 2B and 2C, imaging of the pharmaceutical label 110 is designed to occur at or above a temperature limit of the medication with which pharmaceutical label 110 is associated through control of the coating chemistry, and in particular the sensitizer.

In other embodiments, the chemistry of the functional coating of a two-sided thermal media may be controlled such that one portion or side of an image element, such as a pharmaceutical label, may be imaged at one temperature and another portion or side of the image element may be imaged at another temperature. In one such embodiment, shown in FIGS. 3A, 3B and 3C, only a portion of an image element 200, such as a pharmaceutical label 210, may image when one or more conditions, such as a storage temperature of an associated medication, have been met or exceeded.

Figure 3A:
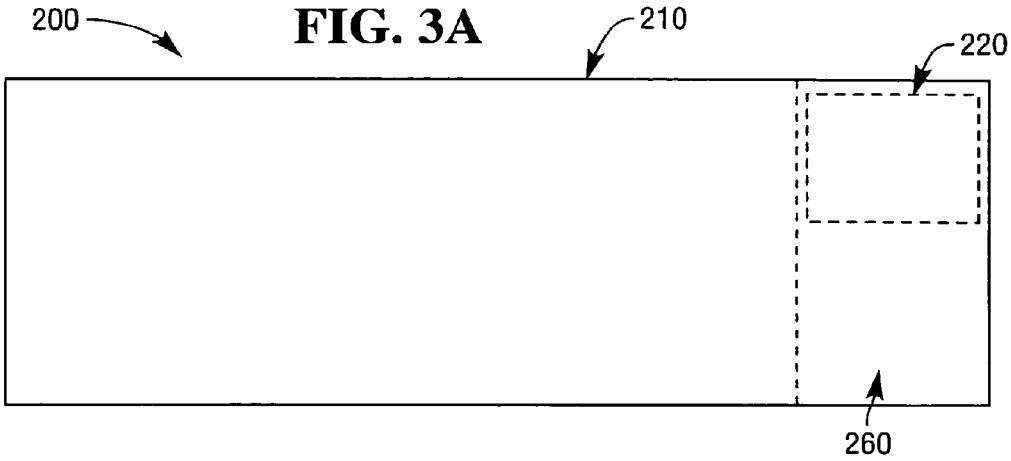
FIG. 3A illustrates an example embodiment of a pharmaceutical label with an invisible pre-printed message and an associated functional coating confined to a particular region of the label.

As shown in FIG. 3A, a warning message 220 may be placed in a region 260 containing a functional coating different from the functional coating on the remainder of pharmaceutical label 210. For example, the functional coating of region 260 may be selected to image at a first temperature, T1, associated with a storage temperature of a medication, while the remainder of the pharmaceutical label 210 may be coated with a functional coating selected to image at second temperature, T2, associated with an operating temperature of a thermal printer 10 with which pharmaceutical label 210 will be selectively printed or imaged. Depending on the application, T1 may be greater than or equal to T2, or vice-versa.

Figure 3B:
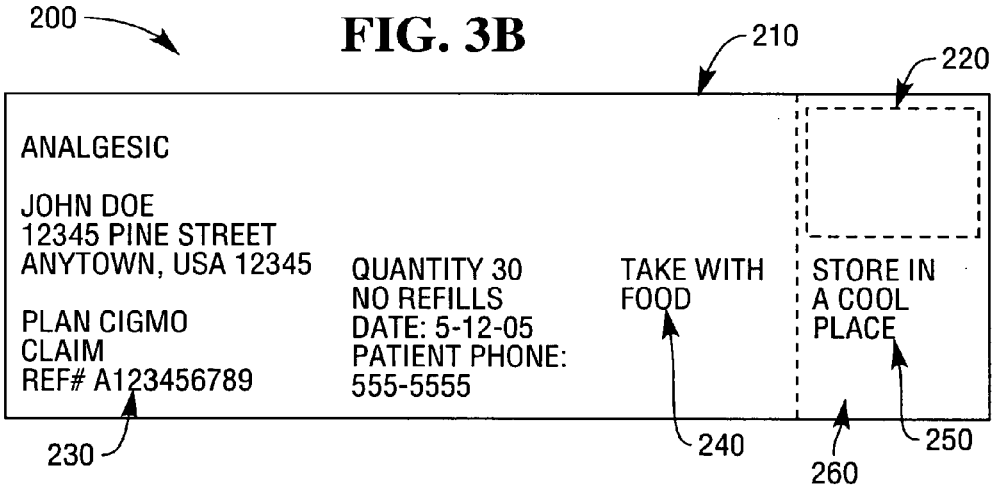
FIG. 3B illustrates an example embodiment of the pharmaceutical label of FIG. 3A selectively imaged to include prescription information, and the like, in regions surrounding the invisible pre-printed message.

As shown in FIG. 3B, pharmaceutical label 210 is selectively imaged to provide prescription information 230, administering information 240, storage and handling information 250, and the like, by a thermal printer such as thermal printer 10 of FIG. 1. The functional coatings for the pharmaceutical label 210 are selected such that first imaging temperature T1 of the region 260 where the warning message 220 is pre-printed is below the second imaging temperature T2 of the remainder of the pharmaceutical label 210. As a result, the storage and handling information 250 may be imaged when the prescription 230, administering 240 and like information are imaged by the thermal printer 10.

Figure 3C:
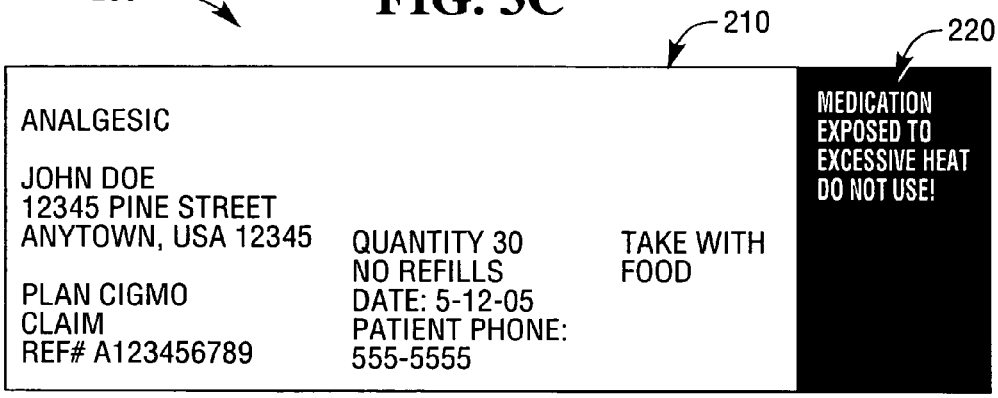
FIG. 3C illustrates an example embodiment of the pharmaceutical label of FIGS. 3A and 3B after exposure to excessive temperature.

As shown in FIG. 3C, upon exceeding the first imaging temperature T1 of the region 260 where the warning message 220 is pre-printed, the region 260 will image revealing the pre-printed warning message 220. However, unless the second imaging temperature, T2, is also exceeded, the remainder of the pharmaceutical label 210 will remain unaffected (e.g., as imaged in FIG. 3B).

In alternate embodiments, both T1 and T2 may be exceeded in which case both the region 260 with the warning message and the remainder of the pharmaceutical label 210 will image, resulting in the pre-printed warning message becoming visible and the prescription 230, administering 240 and like information, becoming obscured or otherwise hidden from view.

Likewise, in alternate embodiments, region 260 may comprise a side, a region of both sides, and the like, of a two-sided thermal media.

As shown in FIGS. 2A, 2B and 2C, and 3A, 3B and 3C, the warning messages 120 and 220 are optimally placed on a portion of the label not imaged with, e.g., prescription information 130 and 230, administering information 140 and 240, storage and handling information 150 and 250, and the like, by a thermal printer 10. However, in other embodiments, by adjusting the opacity of the ink or dye used for the pre-printed message, it is possible to place invisible or imperceptible print, such as a warning message, on areas of an image element, such as a pharmaceutical label, that are to be thermally imaged with, for example, prescription information, administering information, storage and handling information, and the like. This is accomplished by adjusting the transparency or opacity of the pre-printed message to allow the thermally imaged material, such as storage and handling information, to be visible, e.g., appear gray, through the pre-printed message. Where the thermal printing is sparse an observer will not ordinarily detect the hidden message.

In alternate embodiments, a UV absorbing material comprising one or more UV absorbing compounds may be selectively applied to a thermal image element to provide a predetermined sensitivity to UV radiation such that thermal print on some or all of the thermal image element will become invisible or indiscernible at a level of UV radiation at or above which a product or material with which the thermal image element is associated has degraded.

Figure 4A:
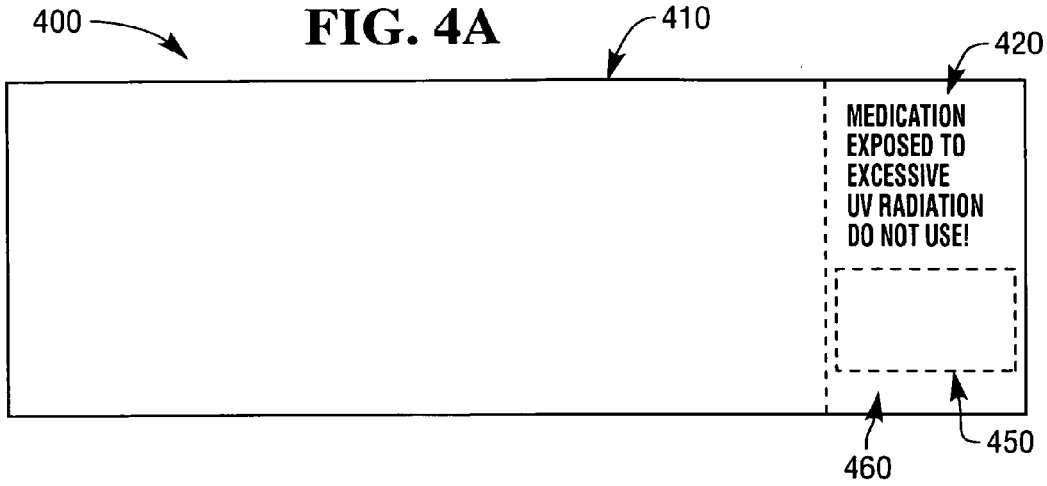
FIG. 4A illustrates an example embodiment of a pharmaceutical label with visible and invisible pre-printed messages confined to a particular region of the label.
Figure 4B:
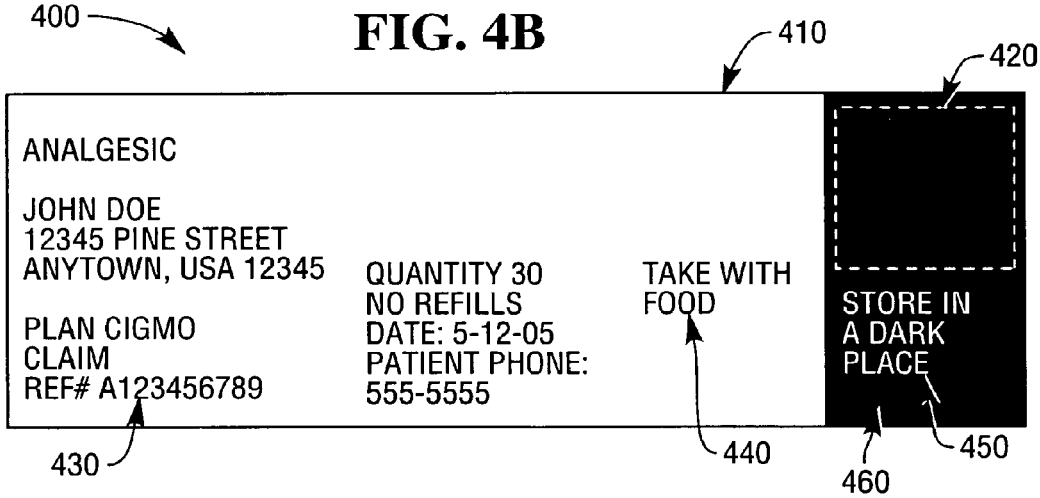
FIG. 4B illustrates an example embodiment of the pharmaceutical label of FIG. 4A selectively imaged to include prescription information, and the like, in regions other than the particular region, and a thermal print block in the particular region.
Figure 4C:
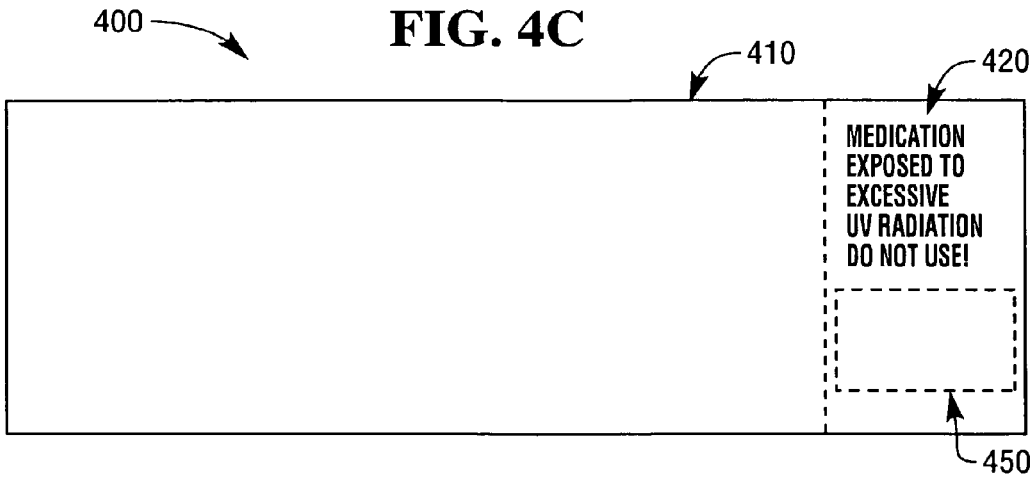
FIG. 4C illustrates an example embodiment of the pharmaceutical label of FIGS. 4A and 4B after exposure to excessive UV radiation.

In one such embodiment, shown in FIGS. 4A, 4B and 4C, thermal media in the form of an image element 400, e.g., a cellulosic substrate with a subcoat and a thermally sensitive functional coat, is provided with a topcoat of a pre-selected UV absorbing material. Image element 400 is shown in the form of a pharmaceutical label 410. The UV absorbing topcoat of pharmaceutical label 410 has been selected in concert with the thermally sensitive coating such that thermal print on pharmaceutical label 410 will become invisible or indiscernible at a level of UV radiation at or above which a medication with which the label is associated will lose its potency, effectiveness or the like.

As shown in FIG. 4A, pharmaceutical label 410 has a white (undeveloped and/or unimaged) background with a warning message 420 pre-printed in a region 460 of the pharmaceutical label 410 using an opaque black ink such that the black on white printing is initially visible to an observer. In addition, pharmaceutical label 410 has storage and handling information 450 pre-printed on the pharmaceutical label 110 in the region 460 using an opaque white ink. As shown in FIG. 4A, the white on white printing is initially invisible, or not obviously visible, to an observer.

In FIG. 4B, the pharmaceutical label 410 of FIG. 4A is shown with selective thermal printing or imaging comprising patient and prescription information 430, administering information 440, and the like. Additional information and/or images are, however, also possible. Selective thermal printing of the pharmaceutical label 410 occurs using, for example, the two-sided direct thermal printer 10 of FIG. 1. In addition to selective imaging to print the above described prescription 430, administering 440 and like information, the region 460 where the warning message 420 and storage and handling information 450 are pre-printed is selectively imaged such that the entire region 460 is thermally imaged, masking or rendering unobvious the warning message 420, while simultaneously making visible the storage and handling information 450.

Subsequently, as shown in FIG. 4C, when the pharmaceutical label 410 is exposed to excess UV radiation, e.g., above a predetermined amount of UV radiation based on selection of the thermally sensitive functional coat and UV absorbing topcoat, the thermal printing on the pharmaceutical label 410, including the thermal printing on the region 460, becomes invisible or indiscernible to an observer, and the warning message 420 in the region 460 becomes visible, warning a user to not take or use the medication with which the pharmaceutical label 410 is associated. Likewise, the prescription information 430, administering information 440, and storage and handling information 450 become invisible or indiscernible to an observer against the background. Various stages of imaging and/or image fading, where some or all of the pre-printed warning message 420 become visible, and some or all of the prescription information 430, administering information 440, storage and handling information 450, and like information become invisible or difficult to discern are, however, also possible.

In alternate embodiments, an image element 400 may include one or both of a pre-printed, initially invisible or indiscernible message such as warning message 420, and a pre-printed, initially visible message such as storage and handling information 450. Further, differing information or messages, including a message 450 suggesting that an amount of UV exposure is still safe and a message 420 suggesting that an unsafe amount of UV exposure has been experienced, and the like, may be provided.

In still other embodiments, the chemistry of the top and/or functional coat of a two-sided thermal image element may be controlled such that thermal print of one portion or side of the image element will disappear or otherwise become indiscernible at a first UV radiation exposure, and thermal print associated with another portion or side of the image element will disappear or become indiscernible at a second UV radiation exposure.

Figure 5A:
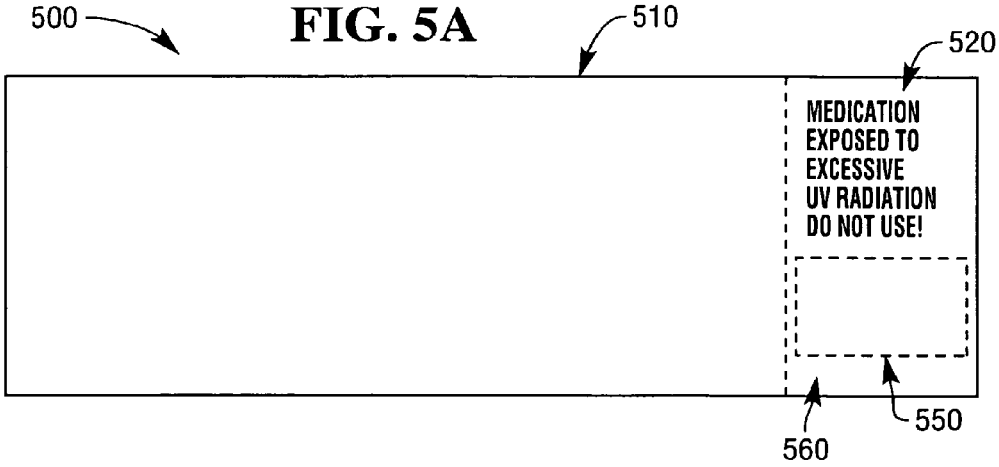
FIG. 5A illustrates an example embodiment of a pharmaceutical label with visible and invisible pre-printed messages and an associated functional coating confined to a particular region of the label.
Figure 5B:
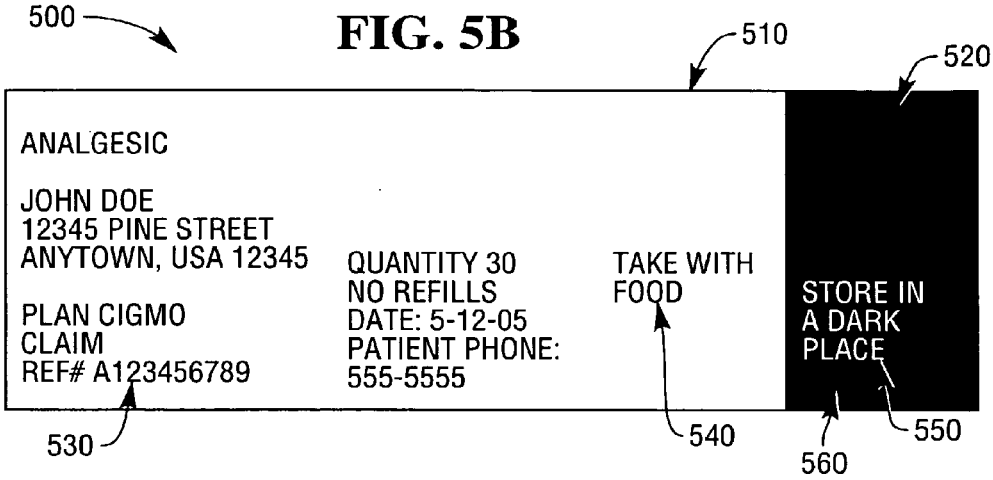
FIG. 5B illustrates an example embodiment of the pharmaceutical label of FIG. 5A selectively imaged to include prescription information, and the like, in regions other than the particular region, and a thermal print block in the particular region.
Figure 5C:
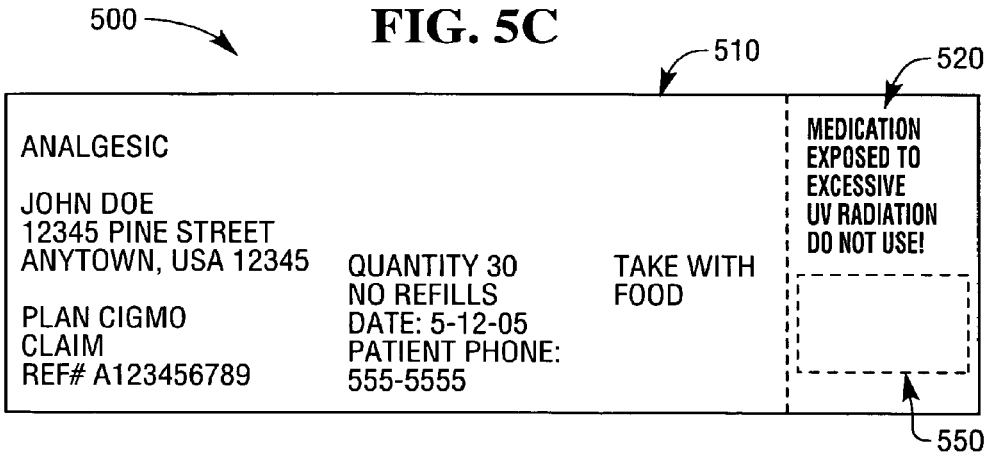
FIG. 5C illustrates an example embodiment of the pharmaceutical label of FIGS. 5A and 5B after exposure to excessive UV radiation.

In one such embodiment, shown in FIGS. 5A, 5B and 5C, thermal media in the form of an image element 500, e.g., a cellulosic substrate with one or more subcoats and thermally sensitive functional coats, is provided with one or more topcoats of pre-selected UV absorbing materials such that the UV sensitivity of thermal print in a first region 560 is different than the UV sensitivity of thermal print in the remainder of the image element 500.

In FIGS. 5A, 5B and 5C, image element 500 is shown in the form of a pharmaceutical label 510. The UV absorbing topcoat used in the region 560 of the pharmaceutical label 510 has been selected in concert with the thermally sensitive coating such that thermal printing in the region 560 of the pharmaceutical label 510 will become invisible or indiscernible at a first level of UV radiation exposure at or above which a medication with which the label 510 is associated will lose its potency, effectiveness or the like. Likewise, the UV absorbing topcoat used on the remainder of the pharmaceutical label 510 has been selected such that thermal printing in the remainder of the label 510 will remain visible for a second, higher level of UV radiation exposure.

As shown in FIG. 5A, pharmaceutical label 510 has a white (undeveloped and/or unimaged) background with a warning message 520 pre-printed in the region 560 of the pharmaceutical label 510 using an opaque black ink such that the black on white printing is initially visible to an observer. In addition, pharmaceutical label 510 has storage and handling information 550 pre-printed on the pharmaceutical label 110 in the region 560 using an opaque white ink. As shown in FIG. 5A, the white on white printing is initially invisible, or not obviously visible, to an observer.

In FIG. 5B, the pharmaceutical label 510 of FIG. 5A is shown with selective thermal printing or imaging comprising patient and prescription information 530, administering information 540, and the like. Additional information and/or images are, however, also possible. Selective thermal printing of the pharmaceutical label 510 occurs using, for example, the two-sided direct thermal printer 10 of FIG. 1. In addition to selective imaging to print the above described prescription 530, administering 540 and like information, the region 560 where the warning message 520 and storage and handling information 550 are pre-printed is selectively imaged such that the entire region 560 is thermally imaged, masking or rendering unobvious the warning message 520, while simultaneously making visible the storage and handling information 550.

Subsequently, as shown in FIG. 5C, when the pharmaceutical label 510 is exposed to excess UV radiation, e.g., above a first predetermined amount of UV radiation based on selection of the thermally sensitive functional coat and/or UV absorbing topcoat in region 560, the thermal printing on the pharmaceutical label 510 in region 560 becomes invisible or indiscernible to an observer, rendering the warning message 520 visible, and the storage and handling information 550 invisible or indiscernible, to an observer. However, as the UV exposure limit of the selected thermally sensitive functional coat and/or UV absorbing top coat on the remainder of the pharmaceutical label 510 has not been met or exceeded, the prescription 530, administering 540, and like information remains visible against the background. Various stages of imaging and/or image fading, where some or all of the pre-printed warning message 520 become visible, and some or all of the prescription 530, administering 540, storage and handling 550, and like information become invisible or difficult to discern are, however, also possible.

Further, in alternate embodiments, an image element 500 such as the pharmaceutical label 510 of FIG. 5A may include one or both of a pre-printed, initially invisible or indiscernible message such as warning message 520, and a pre-printed, initially visible message such as storage and handling information 550. Further, differing, pre-printed information or messages, including a message 550 suggesting that an amount of UV exposure is still safe and a message 520 suggesting that an unsafe amount of UV exposure has been experienced, and the like, may be provided. Likewise, depending on the application, the UV exposure limit of the region 560 may be greater than or equal to the UV exposure limit of the remainder of the image element 500, or vice-versa.

In alternate embodiments, an image or message may be pre-printed on an image element using a material containing a thermally sensitive and/or UV absorbing material. Such pre-printing may occur by, for example, selective application of a thermal ink and/or UV absorbing material in the shape or form of an image, text or other message. Such image or message may then become visible, or invisible, with varying amounts of thermal and/or UV exposure depending its color, and thermal and/or UV properties relative to the color, and thermal and/or UV properties of the surrounding area of the image element.

Further, using an image element in the form of a two-sided thermal paper, a first image or message can be placed on the front of the element with a second image or message on the back, one or both of which may be thermally and/or UV sensitive. This will, for example, free up imaging space on the front of a prescription label for vital prescription information while allowing for thermal and/or UV sensitive warning or other messages to be placed on the back. Using amber colored or other clear or translucent containers, a warning message on such a label may be viewed through a container such a label is attached to. Placing the warning message on the back side of a label also serves to preserve the integrity of the warning feature and prevents premature exposure of the message due to surface contaminates, chemicals, and the like. Alternatively, thermally and/or UV sensitivity information such as a warning message can be placed on either or both the front and back side of the two-sided thermal paper such as a prescription label to provide a dual sided or redundant notification feature.

In various embodiments, the printing layer associated with the warning message may be above or beneath a protective layer. Further, the warning message may be printed using any known or to-be-developed printing process such as lithographic, flexographic, intaglio, relief, screen, inkjet, and the like.

It should also be noted that embodiments are not limited to white thermal paper with black thermal dyes pre-printed with white or black inks as virtually any other color paper, thermal dyes and inks may be used.

Additionally, thermal media or other image elements may take a form other than a label including sheet media, roll stock, tags, pamphlets, receipts and the like. Further, a hidden message may take the form of any warning message or image such as a red circle with a line through it, a skull and cross bones, images of the medication, a graphic "X" across a label, and the like, in addition to or in place of a warning message or text. Likewise, a hidden, positive message such as a message stating that a material such as a medication has achieved an appropriate condition, such as an appropriate temperature for administering, may be provided in addition to or in place of a hidden, warning message.

The above description is illustrative, and not restrictive. Many other embodiments will be apparent to those of skill in the art upon reviewing the above description. The scope of the embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

We claim:

1. A method comprising:

providing an image element;

providing a first thermally sensitive coating on at least a first portion of the image element:

pre-printing a first mark on the first portion of the image element, wherein the first pre-printed mark comprises non-thermally sensitive ink; and associating the image element with a material, wherein the first pre-printed mark is not readily discernible until the first portion of the image element is exposed to a temperature at or above which the material is expected to degrade.

2. The method of claim 1, wherein the first thermally sensitive coating comprises a leuco dye, a developer and a sensitizer.

3. The method of claim 1, further comprising:

selectively thermally imaging the image element, wherein selectively thermally imaging the image element comprises thermally imaging other than the first portion of the image element.

4. The method of claim 3, wherein the image element is in the form of a label, the method further comprising applying the label to a container of the material.

5. The method of claim 1, wherein the first pre-printed mark comprises a message warning a user that the material has been exposed to a temperature at or above which the material is expected to degrade.

6. The method of claim 1, wherein the image element further comprises a UV absorbing material on at least the first portion of the image element and a second mark printed on a second portion of the image element, wherein the second printed mark is not readily discernible after the second portion of the image element has been exposed to heat and thereafter becomes readily discernable when the second portion of the image element is exposed to an amount of UV radiation at or above which the material is expected to degrade.

7. The method of claim 6, further comprising:

exposing the second portion of the image element to heat to thermally image the second portion of the image element such that the second printed mark is not readily discernible.

8. The method of claim 6, wherein the first portion of the image element comprises a first portion of a first side of the image element, and the second portion of the image element comprises a second portion of the first side of the image element different from the first portion.

9. A method comprising:

providing an image element;

providing a first thermally sensitive coating on at least a first portion of the image element;

pre-printing a mark on a second portion of the image element; and associating the image element with a material, wherein (i) the pre-printed mark comprises non-thermally sensitive ink, and (ii) the pre-printed mark is not readily discernible after the second portion of the image element has been exposed to heat and thereafter becomes readily discernible when the second portion of the image element is exposed to an amount of UV radiation at or above which the material is expected to degrade.

10. The method of claim 9, further comprising:

exposing the second portion of the image element to heat to thermally image the second portion of the image element such that the pre-printed mark is not readily discernible.

11. The method of claim 10, further comprising:

selectively thermally imaging the image element, wherein selectively thermally imaging the image element comprises thermally printing information in other than the second portion of the image element.

12. The method of claim 11, wherein the image element is in the form of a label, the method further comprising applying the label to a container of the material.

13. The method of claim 12, wherein the pre-printed mark comprises a message warning a user that the material has been exposed to an amount of UV radiation at or above which the material is expected to degrade.

14. A method comprising:

providing an image element;

providing a first thermally sensitive coating on at least a first portion of the image element:

printing a first mark on the first portion of the image element; and associating the image element with a material wherein the first printed mark is not readily discernible until the first portion of the image element is exposed to a temperature at or above which the material is expected to degrade;

wherein the image element further comprises a UV absorbing material on at least the first portion of the image element and a second mark printed on a second portion of the image element, wherein the second printed mark is not readily discernible after the second portion of the image element has been exposed to heat and thereafter becomes readily discernible when the second portion of the image element is exposed to an amount of UV radiation at or above which the material is expected to degrade;

wherein the first portion of the image element corresponds to a first side of the image element and the second portion of the image element corresponds to a second side of the image element opposite the first side.

15. The method of claim 1, wherein the non-thermally sensitive ink of the first pre-printed mark comprises an opaque white ink.

16. The method of claim 9, wherein the non-thermally sensitive ink of the pre-printed mark comprises an opaque black ink.

* * * * *